US008022882B2

(12) United States Patent
Tsai et al.

(10) Patent No.: US 8,022,882 B2
(45) Date of Patent: Sep. 20, 2011

(54) ANTENNA DEVICE FOR WIRELESS WIDE AREA NETWORK (WWAN) AND WIRELESS LOCAL AREA NETWORK (WLAN)

(75) Inventors: Tiao-Hsing Tsai, Tao Yuan Shien (TW); Chih-Wei Liao, Tao Yuan Shien (TW); Chao-Hsu Wu, Tao Yuan Shien (TW)

(73) Assignee: Quanta Computer Inc., Tao Yuan Shien (TW)

( * ) Notice: Subject to any disclaimer, the term of this patent is extended or adjusted under 35 U.S.C. 154(b) by 379 days.

(21) Appl. No.: 12/423,045

(22) Filed: Apr. 14, 2009

(65) Prior Publication Data

US 2010/0149043 A1 Jun. 17, 2010

(30) Foreign Application Priority Data

Dec. 15, 2008 (TW) ..... 97148751 A

(51) Int. Cl.
*H01Q 1/38* (2006.01)

(52) U.S. Cl. ..... 343/700 MS; 343/702; 343/846

(58) Field of Classification Search ..... 343/700 MS, 343/702, 846
See application file for complete search history.

(56) References Cited

U.S. PATENT DOCUMENTS 7,446,717 B2 * 11/2008 Hung et al. ..... 343/702
7,498,992 B2 * 3/2009 Hung et al. ..... 343/702
7,746,288 B2 * 6/2010 Wang et al. ..... 343/846
7,868,831 B2 * 1/2011 Hung et al. ..... 343/700 MS

* cited by examiner

*Primary Examiner* — Hoang V Nguyen
(74) *Attorney, Agent, or Firm* — Ladas & Parry LLP

(57) ABSTRACT

An antenna device includes a grounding element, a radiating element, and first and second feeding elements. The radiating element includes a first segment that extends from the grounding element and that has an end distal from the grounding element, and second and third segments that extend from the end of the first segment in opposite directions. Each of the first and second feeding elements includes first and second segments. The first segment of each of the first and second feeding elements is disposed proximate to a respective one of the second and third segments of the radiating element. The second segment of each of the first and second feeding elements is disposed proximate to the grounding element.

14 Claims, 10 Drawing Sheets

WWAN 2110 MHz

H Plane(X-Y plane, $\theta$=90)

Peak = 0dBi, Avg. = -3.6dBi.

E1 Plane(Z-X plane, Ø=0)

Peak = 2.8 dBi, Avg. = -2.4 dBi.

E2 Plane(Y-Z plane, Ø=90)

Peak = -2.3 dBi, Avg. = -6.8dBi.

ANTENNA DEVICE FOR WIRELESS WIDE AREA NETWORK (WWAN) AND WIRELESS LOCAL AREA NETWORK (WLAN)

CROSS-REFERENCE TO RELATED APPLICATION

This application claims priority of Taiwanese Application No. 097148751, filed on Dec. 15, 2008.

BACKGROUND OF THE INVENTION

1. Field of the Invention

This invention relates to an antenna device, more particularly to an antenna device that is suitable for wireless wide area network (WWAN) and wireless local area network (WLAN) applications.

2. Description of the Related Art

FIG. 1 illustrates a conventional antenna device that is operable in wireless wide area network (WWAN) frequency bands, i.e., from 824 MHz to 960 MHz and from 1710 MHz to 2170 MHz, and wireless local area network (WLAN) frequency bands, i.e., from 2412 MHz to 2462 MHz and from 4900 MHz to 5875 MHz. The conventional antenna device is installed in a space 90 in a top edge of a display unit 95 of a notebook computer 9, as illustrated in FIG. 2, and includes first and second antennas 91, 92, and first and second feeding lines 93, 94, each of which is connected to a respective one of the first and second antennas 91, 92.

Although the aforementioned conventional antenna device achieves its intended purpose, the first and second antennas 91, 92 thereof have to be separated from each other to prevent interference therebetween.

SUMMARY OF THE INVENTION

Therefore, the object of the present invention is to provide an antenna device that is applicable to a wireless wide area network (WWAN) and a wireless local area network (WLAN) and that has a relatively small size.

According to the present invention, an antenna device comprises a grounding element, a radiating element, and first and second feeding elements. The radiating element includes a first segment that extends from the grounding element and that has an end distal from the grounding element, and second and third segments that extend from the end of the first segment in opposite directions. Each of the first and second feeding elements includes first and second segments. The first segment of each of the first and second feeding elements is disposed proximate to a respective one of the second and third segments of the radiating element. The second segment of each of the first and second feeding elements is disposed proximate to the grounding element.

BRIEF DESCRIPTION OF THE DRAWINGS

Other features and advantages of the present invention will be come apparent in the following detailed description of the preferred embodiment with reference to the accompanying drawings, of which.

DETAILED DESCRIPTION OF THE PREFERRED EMBODIMENT

Figure 1:
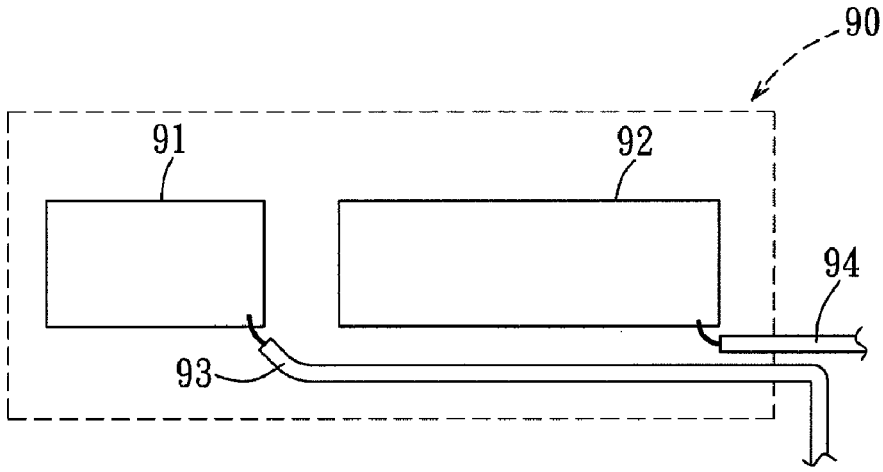
FIG. 1 PRIOR ART
FIG. 1 is a schematic view of a conventional antenna device.
Figure 2:
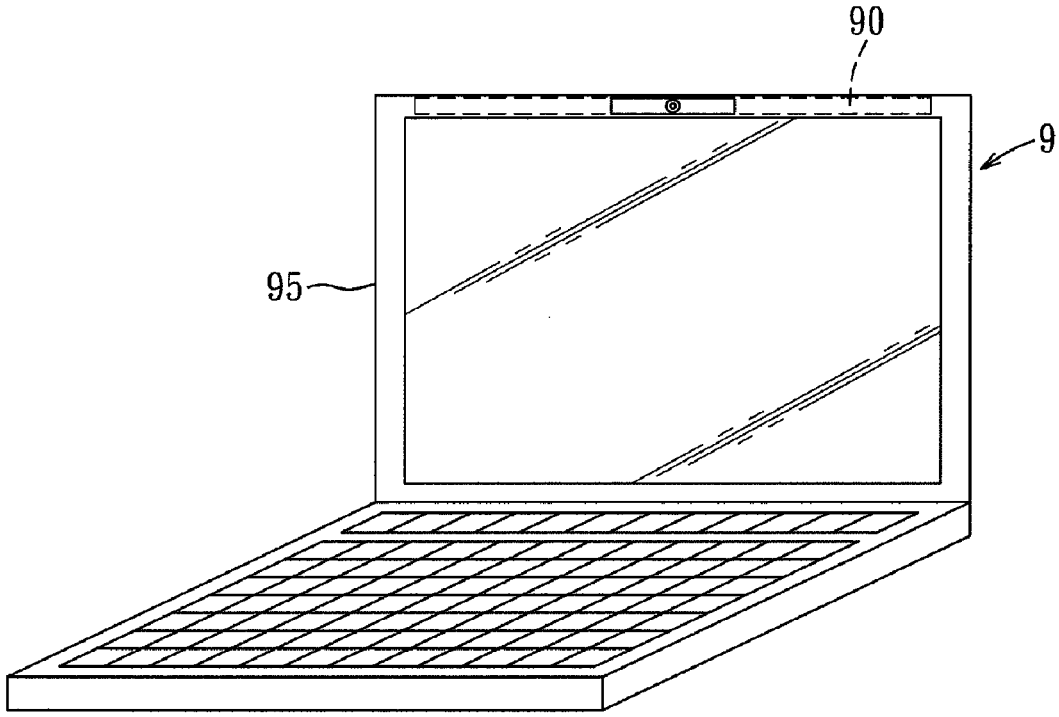
FIG. 2 PRIOR ART
FIG. 2 is a perspective view illustrating a notebook computer in which the conventional antenna device is installed.
Figure 3:
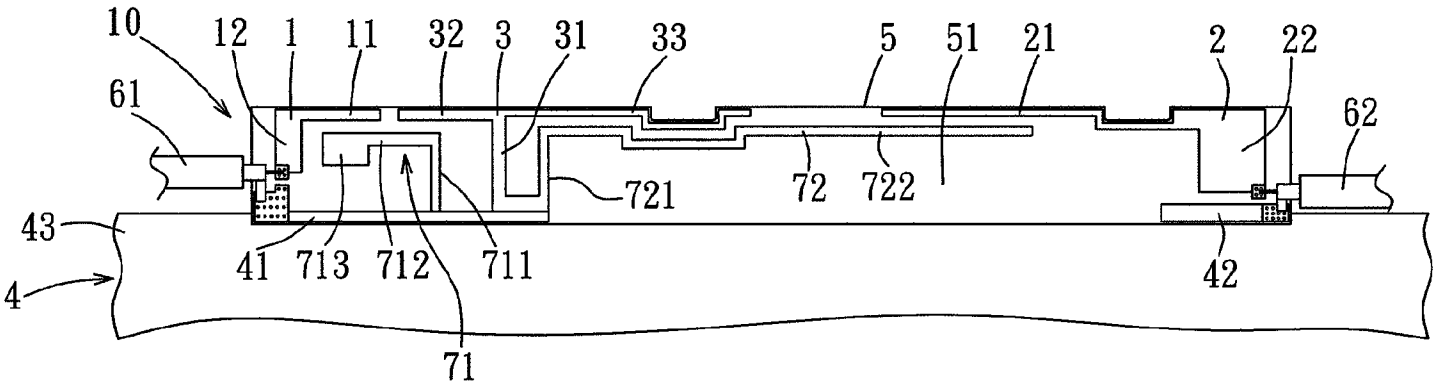
FIG. 3 is a schematic view of the preferred embodiment of an antenna device according to the present invention.

Referring to FIG. 3, the preferred embodiment of an antenna device 10 according to this invention is shown to include a grounding element 4, a radiating element 3, and first and second feeding elements 1, 2.

The antenna device 10 of this invention is suitable for application in a wireless wide area network (WWAN) and a wireless local area network (WLAN).

Figure 5:
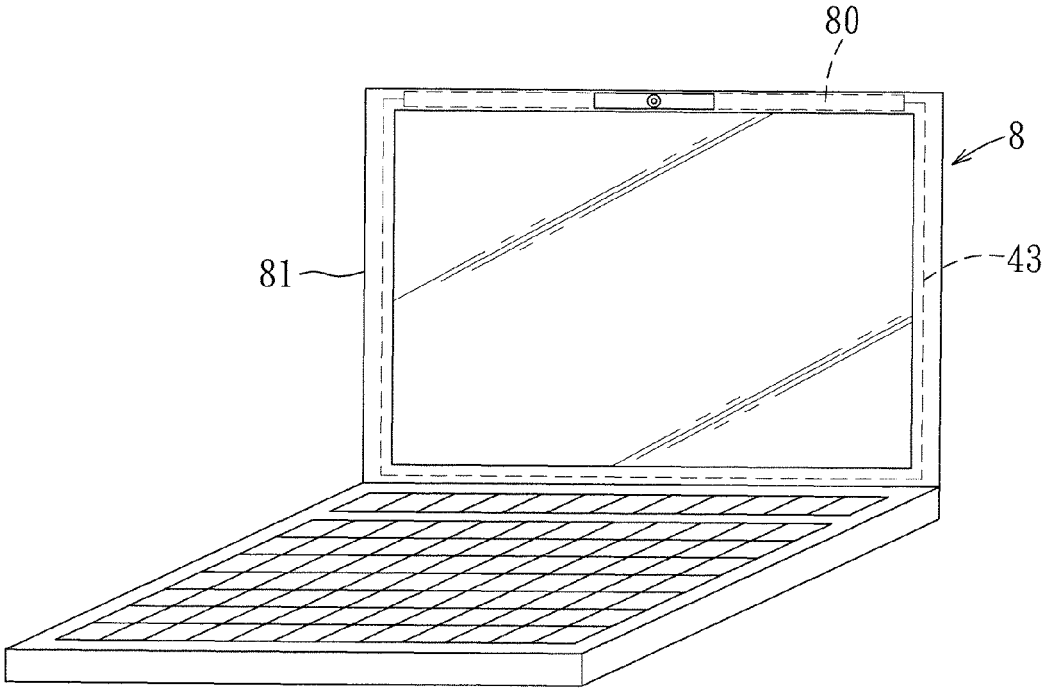
FIG. 5 is a perspective view illustrating a notebook computer in which the preferred embodiment is installed.

The antenna device 10 further includes a dielectric substrate 5 that is disposed in a space 80 in a top edge of a display unit 81 of a notebook computer 8, as illustrated in FIG. 5, that is generally rectangular in shape, and that has upper- and lower-left corners and upper- and lower-right corners.

The grounding element 4 includes a metallic foil 43, and first and second grounding strips 41, 42. The metallic foil 43 is disposed in the display unit 81 of the notebook computer 8, is connected to the notebook computer 8, and serves as an electrical ground. The first grounding strip 41 is formed on a surface 51 of the dielectric substrate 5 and extends from the lower-left corner of the dielectric substrate 5 toward the lower-right corner of the dielectric substrate 5. The second grounding strip 42 is formed on the surface 51 of the dielectric substrate 5 and extends from the lower-right corner of the dielectric substrate 5 toward the lower-left corner of the dielectric substrate 5.

The radiating element 3 is formed on the surface 51 of the dielectric substrate 5, is generally T-shaped, and includes first, second, and third segments 31, 32, 33. The first segment 31 of the radiating element 3 extends from the first grounding strip 41 of the grounding element 4, and has an end distal from the first grounding strip 41 of the grounding element 4. The second and third segments 32, 33 of the radiating element 3 extend from the end of the first segment 31 of the radiating element 3 in opposite directions.

The first feeding element 1 is formed on the surface 51 of the dielectric substrate 5, is generally L-shaped, and includes first and second segments 11, 12. Each of the first and second segments 11, 12 of the first feeding element 1 is disposed proximate to a respective one of the second segment 32 of the radiating element 3 and the first grounding strip 41 of the grounding element 4. In this embodiment, the first segment 11 of the first feeding element 1 and the second segment 32 of the radiating element 3 are substantially collinear. Moreover, in this embodiment, the second segment 12 of the first feeding element 1 and the second segment 32 of the radiating element 3 define a distance therebetween larger than that defined between the first segment 11 of the first feeding element 1 and the second segment 32 of the radiating element 3. Further, in this embodiment, the second segment 12 of the first feeding element 1 extends from the first segment 11 of the first feeding element 1 toward the first grounding strip 41 of the grounding element 4.

The second feeding element 2 is formed on the surface 51 of the dielectric substrate 5, is generally L-shaped, and includes first and second segments 21, 22. Each of the first and second segments 21, 22 of the second feeding element 2 is disposed proximate to a respective one of the third segment 33 of the radiating element 3 and the second grounding strip 42 of the grounding element 4. In this embodiment, the first segment 21 of the second feeding element 2 and the third segment 33 of the radiating element 3 have portions that are substantially collinear. Moreover, in this embodiment, the second segment 22 of the second feeding element 2 and the third segment 33 of the radiating element 3 define a distance therebetween larger than that defined between the first segment 21 of the second feeding element 2 and the third segment 33 of the radiating element 3. Further, in this embodiment, the second segment 22 of the second feeding element 2 extends from the first segment 21 of the second feeding element 2 toward the second grounding strip 42 of the grounding element 4.

The second segment 12 of the first feeding element 1 has an end distal from the first segment 11 of the first feeding element 1. The first grounding strip 41 of the grounding element 4 has an end distal from the second grounding strip 42 of the grounding element 4.

The second segment 22 of the second feeding element 2 has an end distal from the first segment 21 of the second feeding element 2. The second grounding strip 42 of the grounding element 4 has an end distal from the first grounding strip 41 of the grounding element 4.

The antenna device 10 further includes first and second feeding lines 61, 62, each of which is connected to a signal source (not shown) of the notebook computer 8, each of which has a positive terminal connected to the end of the second segment 12, 22 of a respective one of the first and second feeding elements 1, 2, and each of which has a negative terminal connected to the end of a respective one of the first and second grounding strips 41, 42 of the grounding element 4. As such, each of the first and second feeding lines 61, 62 may be routed along a respective one of left and right edges of the display unit 81 of the notebook computer 8 instead of along the top edge of the display unit 81 of the notebook computer 8.

The antenna device 10 further includes first and second parasitic elements 71, 72, each of which is formed on the surface 51 of the dielectric substrate 5 and between which the first segment 31 of the radiating element 3 is disposed.

The first parasitic element 71 is generally L-shaped, and includes first, second, and third segments 711, 712, 713. The first segment 711 of the first parasitic element 71 is connected to the first grounding strip 41 of the grounding element 4, is substantially parallel to the first segment 31 of the radiating element 3, and has an end distal from the first grounding strip 41 of the grounding element 4. The second segment 712 of the first parasitic element 71 extends from the end of the first segment 711 of the first parasitic element 71 away from the first segment 31 of the radiating element 3, and has a pair of portions, each of which is substantially parallel to a respective one of the second segment 32 of the radiating element 3 and the first segment 11 of the first feeding element 1, and an end distal from the first segment 711 of the first parasitic element 71. The third segment 713 of the first parasitic element 71 extends from the end of the second segment 712 of the first parasitic element 71 and is substantially parallel to the second segment 12 of the first feeding element 1.

The second parasitic element 72 is generally L-shaped, and includes first and second segments 721, 722. The first segment 721 of the second parasitic element 72 is connected to the first grounding strip 41 of the grounding element 4, is substantially parallel to the first segment 31 of the radiating element 3, and has an end distal from the first grounding strip 41 of the grounding element 4. The second segment 722 of the second parasitic element 72 extends from the end of the first segment 721 of the second parasitic element 72 away from the first segment 31 of the radiating element 3, and has a pair of portions, each of which is substantially parallel to a respective one of the third segment 33 of the radiating element 3 and the first segment 21 of the second feeding element 2.

Figure 4:
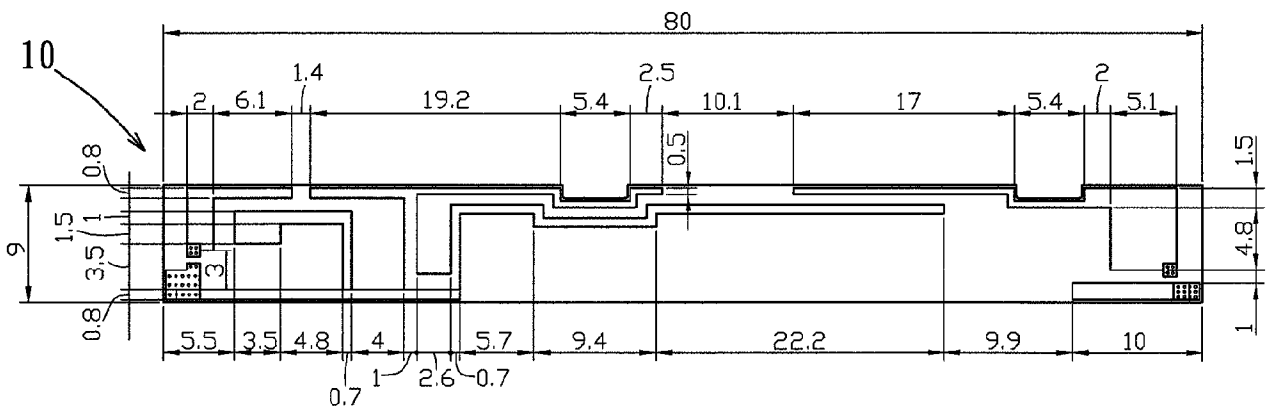
FIG. 4 is a schematic view illustrating dimensions, in millimeter, of a dielectric substrate, a grounding element, a radiating element, first and second feeding elements, and first and second parasitic elements of the preferred embodiment.

In this embodiment, the dielectric substrate 5, the first and second grounding strips 41, 42 of the grounding element 4, the radiating element 3, the first and second feeding elements 1, 2, and the first and second parasitic elements 71, 72 have dimensions illustrated in FIG. 4. Moreover, in this embodiment, the second feeding element 2, the first and third segments 31, 33 of the radiating element 3, and the second grounding strip 42 of the grounding element 4 cooperatively operate in a high WWAN frequency band from 1710 MHz to 2170 MHz. On the other hand, the second parasitic element 72 operates in a low WWAN frequency band from 824 MHz to 960 MHz. Further, in this embodiment, the first feeding element 1, the first and second segments 31, 32 of the radiating element 3, and the first grounding strip 41 of the grounding element 4 cooperatively operate in a high WLAN frequency band from 4900 MHz to 5875 MHz. On the other hand, the first parasitic element 71 operates in a low WLAN frequency band from 2412 MHz to 2462 MHz.

Figure 6:
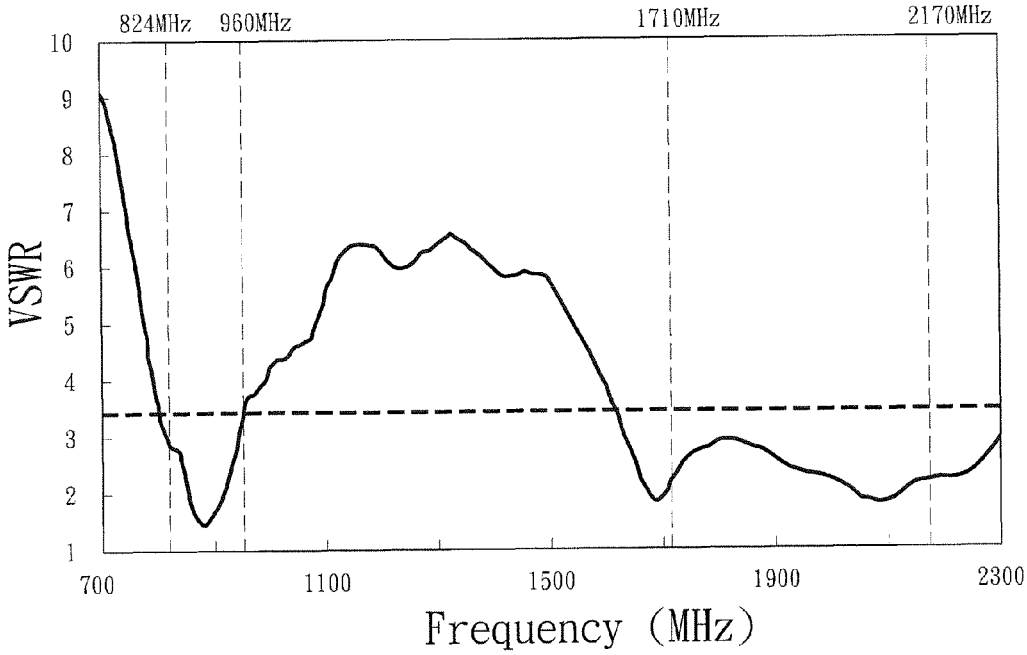
FIGS. 6 and 7 are plots illustrating voltage standing wave ratios (VSWRs) of the preferred embodiment.
Figure 7:
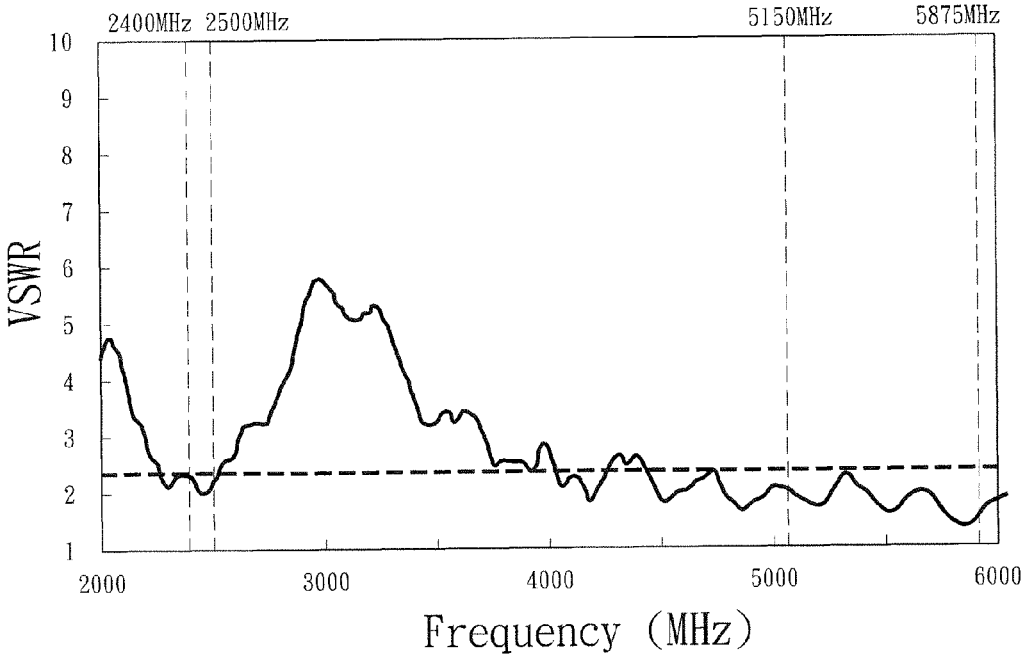
Figure 8:
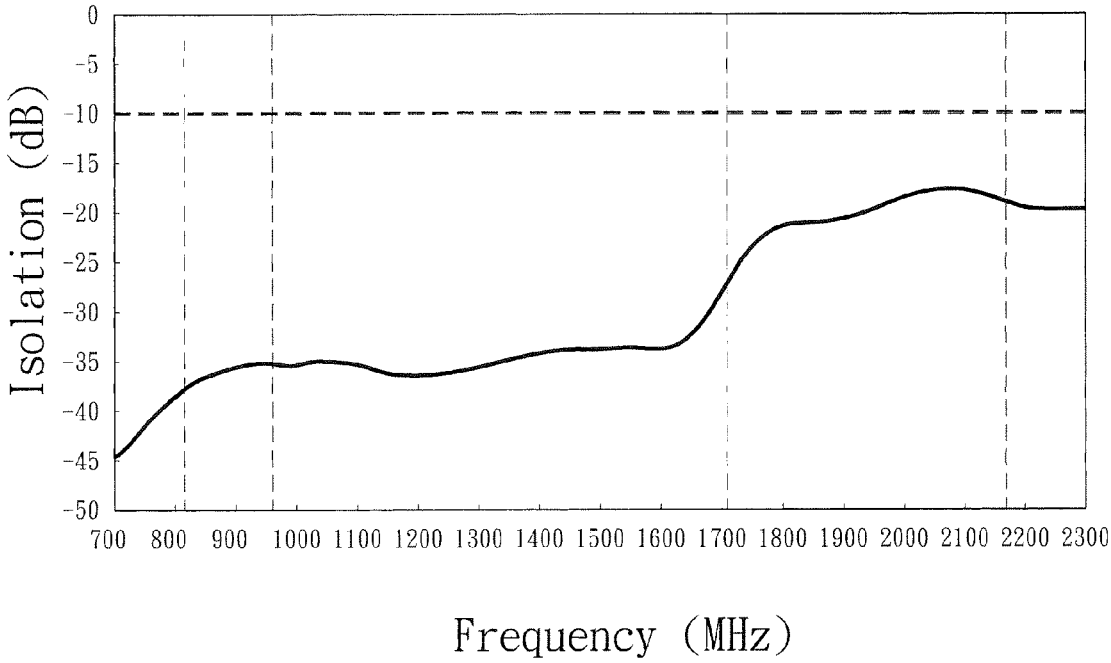
FIG. 8 is a plot illustrating an isolation of the preferred embodiment.
Figure 9:
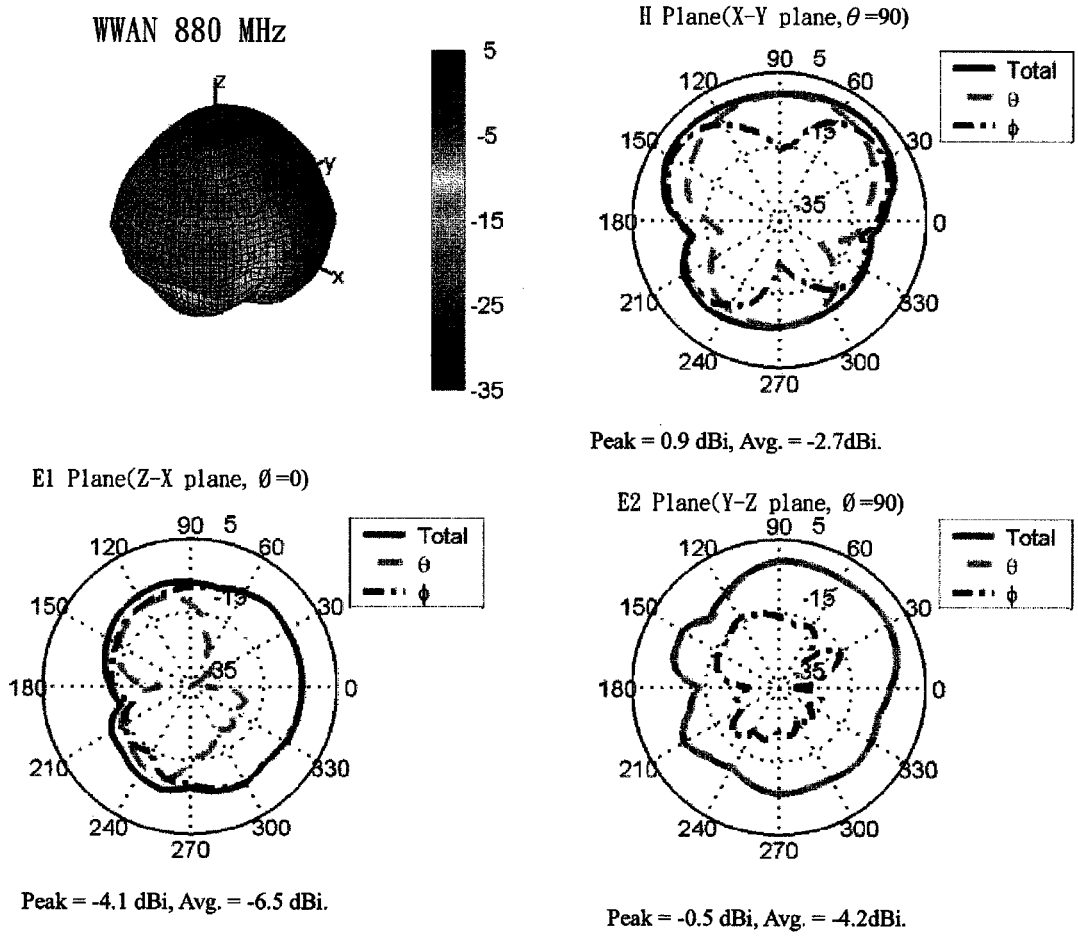
FIG. 9 are plots illustrating radiation patterns of the preferred embodiment on the x-y, z-x, and y-z planes when operated at 880 MHz.
Figure 10:
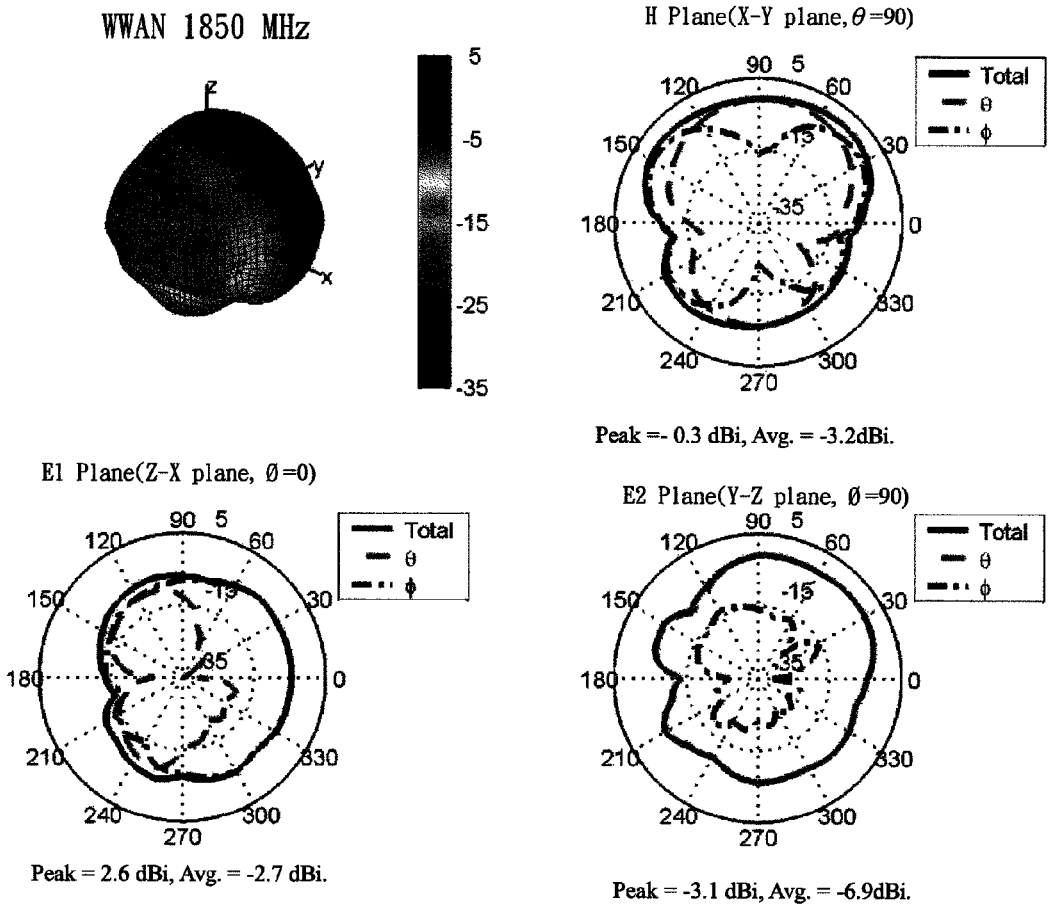
FIG. 10 are plots illustrating radiation patterns of the preferred embodiment on the x-y, z-x, and y-z planes when operated at 1850 MHz.
Figure 11:
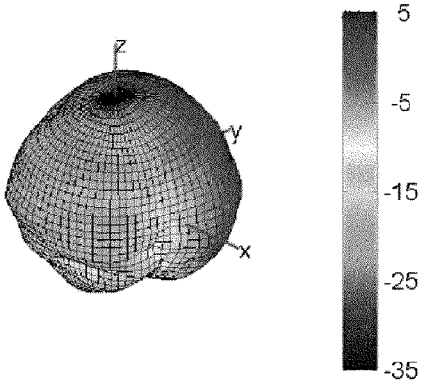
FIG. 11 are plots illustrating radiation patterns of the preferred embodiment on the x-y, z-x, and y-z planes when operated at 2110 MHz.
Figure 11:
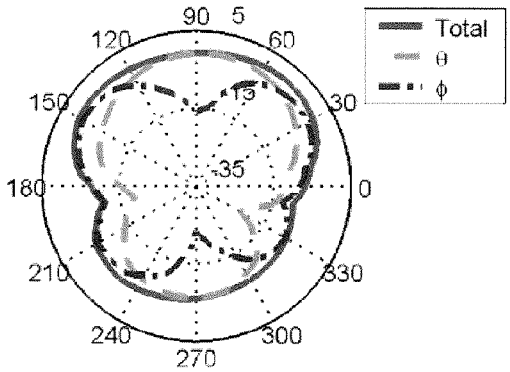
Figure 11:
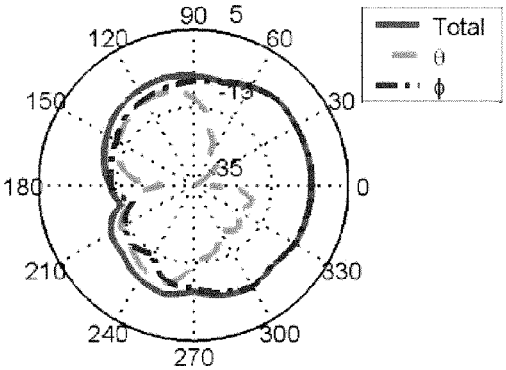
Figure 11:
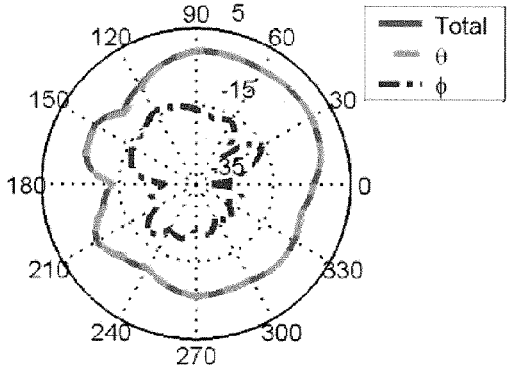
Figure 12:
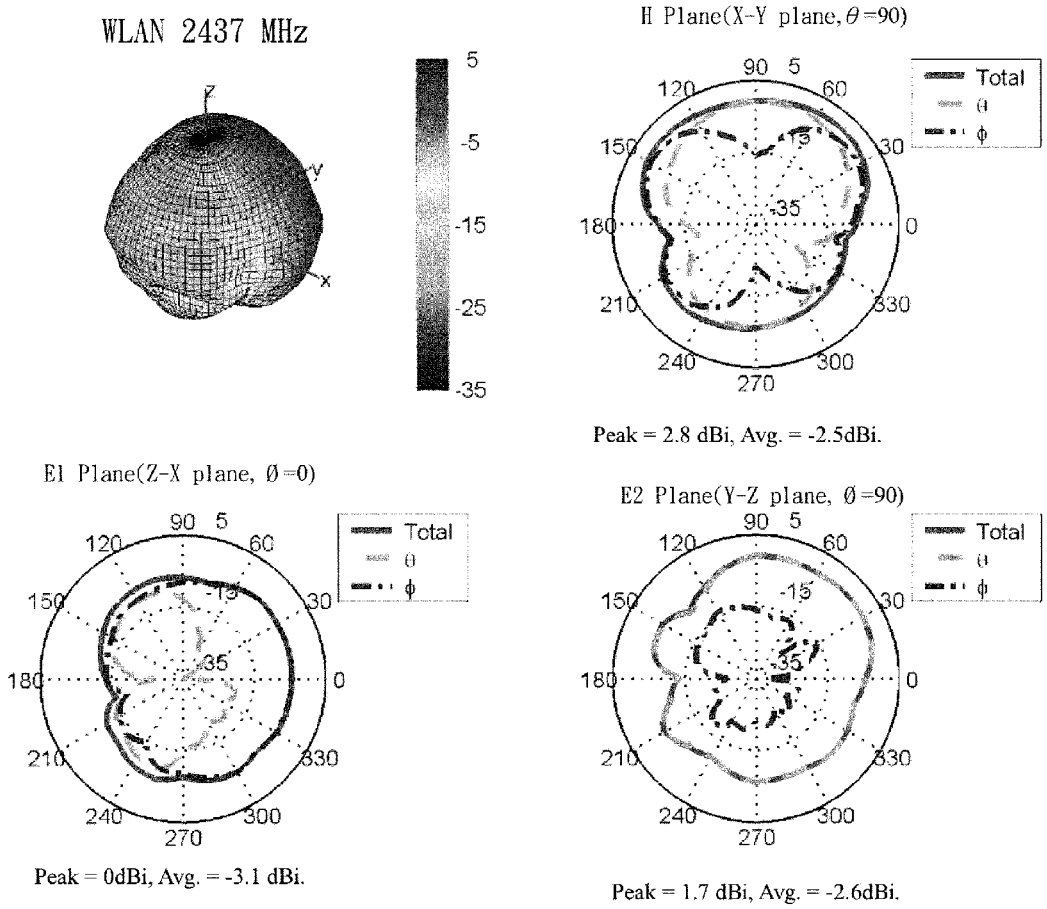
FIG. 12 are plots illustrating radiation patterns of the preferred embodiment on the x-y, z-x, and y-z planes when operated at 2437 MHz.
Figure 13:
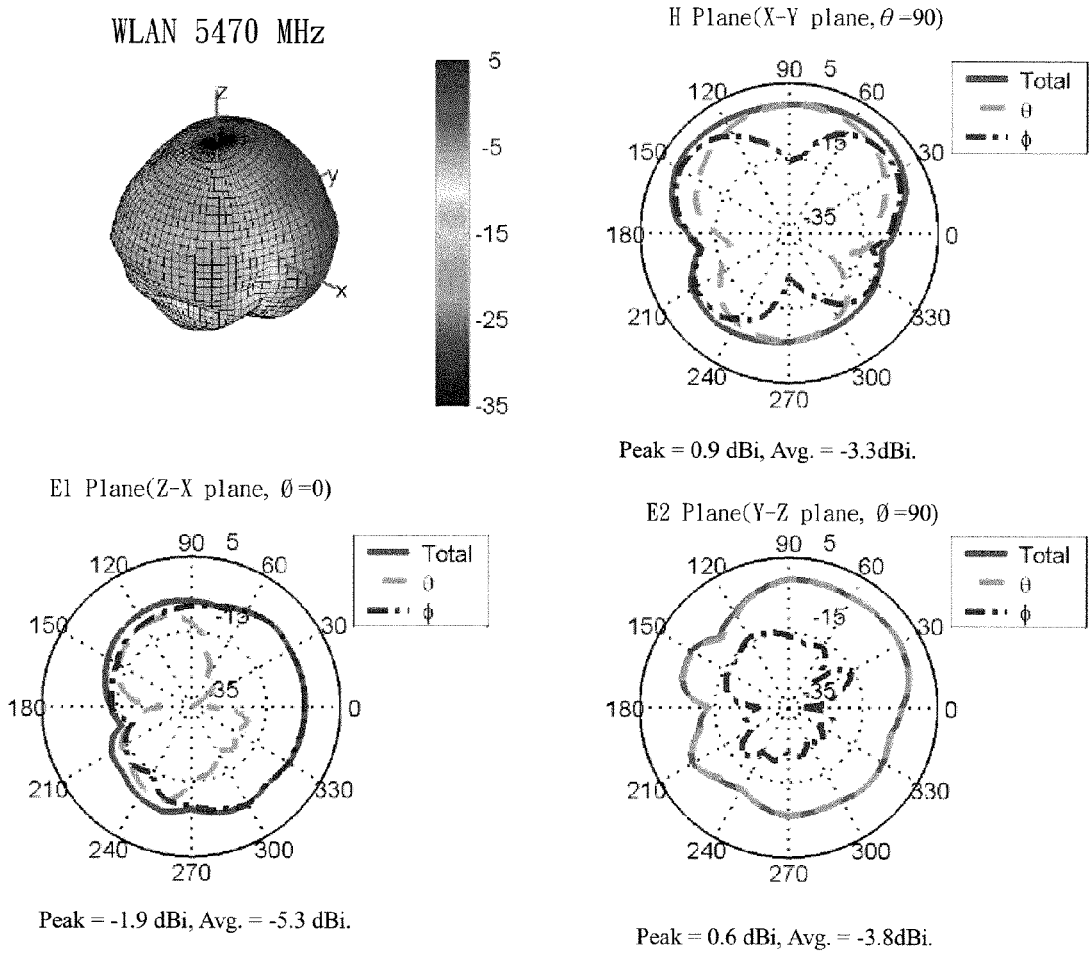
FIG. 13 are plots illustrating radiation patterns of the preferred embodiment on the x-y, z-x, and y-z planes when operated at 5470 MHz.

Experimental results show that the antenna device 10 of this invention achieves a voltage standing wave ratio (VSWR) of less than 4.0 when operated in frequency bands from 824 MHz to 960 MHz and from 1710 MHz to 2170 MHz, as illustrated in FIG. 6, and a VSWR of less than 3.0 when operated in frequency bands from 2400 MHz to 2500 MHz and from 5150 MHz to 5875 MHz, as illustrated in FIG. 7. Moreover, the antenna device 10 of this invention achieves total radiation powers (TRP) efficiencies of at least −5.4 dB and 28.8% when operated at frequencies in the low and high WWAN frequency bands, as shown in Table I below, and TRP efficiencies of at least −4.5 dB and 35.2% when operated at frequencies in the low and high WLAN frequency bands, as shown in Table II below. Further, since the first segment 31 of the radiating element 3 resonates in the low and high WWAN frequency bands and the low and high WLAN frequency bands, the antenna device 10 of this invention achieves an isolation of less than −10 dB, as illustrated in FIG. 8. Still further, as illustrated in FIGS. 9 to 13, the antenna device 10 of this invention has substantially omnidirectional radiation patterns on the x-y, z-x, and y-z planes when operated at each 880 MHz, 1850 MHz, 2110 MHz, 2437 MHz, and 5470 MHz.

TABLE I

| Frequency (MHz) | | | Efficiency (dB) | Efficiency (%) |
|---|---|---|---|---|
| WWAN low band | 850 Tx | 824 | −5.3 | 28.8 |
| | | 836 | −5.2 | 30.9 |
| | | 849 | −5.2 | 30.9 |
| | 850 Rx | 869 | −3.8 | 41.5 |
| | | 880 | −3.6 | 43.5 |
| | | 894 | −3.9 | 41.1 |
| | 900 Tx | 880 | −3.7 | 43.7 |
| | | 900 | −3.9 | 39.1 |
| | | 915 | −4.2 | 35.8 |
| | 900 Rx | 925 | −4.9 | 33.1 |
| | | 940 | −5.1 | 30.9 |
| | | 960 | −5.4 | 29.5 |
| WWAN high band | 1800 Tx | 1710 | −3.7 | 42.7 |
| | | 1750 | −3.4 | 45.7 |
| | | 1785 | −3.2 | 47.9 |
| | 1830 Rx | 1805 | −4.6 | 36.3 |
| | | 1840 | −4.7 | 35.5 |
| | | 1850 | −4.7 | 35.5 |
| | 1900 Tx | 1850 | −3.7 | 42.7 |
| | | 1880 | −3.8 | 41.7 |
| | | 1910 | −4.0 | 39.8 |
| | 1900 Rx | 1920 | −4.1 | 38.9 |
| | | 1950 | −3.9 | 40.7 |
| | | 1980 | −4.0 | 38.9 |
| | 2100 Tx | 1930 | −3.8 | 41.7 |
| | | 1960 | −3.6 | 43.7 |
| | | 1990 | −3.5 | 44.7 |
| | 2100 Rx | 2110 | −3.5 | 44.7 |
| | | 2140 | −3.6 | 43.7 |
| | | 2170 | −3.8 | 41.7 |

TABLE II

| Frequency (MHz) | | Efficiency (dB) | Efficiency (%) |
|---|---|---|---|
| 802.11 b/g | 2412 | −3.2 | 47.9 |
| | 2437 | −2.8 | 52.5 |
| | 2462 | −3.3 | 46.8 |
| 802.11 a | 5150 | −3.8 | 42.1 |
| | 5350 | −3.9 | 41.2 |
| | 5470 | −4.1 | 39.0 |
| | 5725 | −4.5 | 35.2 |
| | 5875 | −3.5 | 44.3 |

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. An antenna device, comprising:

a grounding element;

a radiating element including a first segment that extends from said grounding element and that has an end distal from said grounding element, and second and third segments that extend from said end of said first segment in opposite directions; and first and second feeding elements, each of which includes first and second segments, said first segment of each of said first and second feeding elements being disposed proximate to a respective one of said second and third segments of said radiating element, said second segment of each of said first and second feeding elements being disposed proximate to said grounding element.

2. The antenna device as claimed in claim 1, wherein said second segment of said first feeding element and said second segment of said radiating element define a distance therebetween larger than that defined between said first segment of said first feeding element and said second segment of said radiating element.

3. The antenna device as claimed in claim 2, wherein said first feeding element is generally L-shaped, said first segment of said first feeding element and said second segment of said radiating element being substantially collinear, said second segment of said first feeding element extending from said first segment of said first feeding element toward said grounding element.

4. The antenna device as claimed in claim 1, wherein said second segment of said second feeding element and said third segment of said radiating element define a distance therebetween larger than that defined between said first segment of said second feeding element and said third segment of said radiating element.

5. The antenna device as claimed in claim 4, wherein said second feeding element is generally L-shaped, said first segment of said second feeding element and said third segment of said radiating element having portions that are substantially collinear, said second segment of said second feeding element extending from said first segment of said second feeding element toward said grounding element.

6. The antenna device as claimed in claim 1, further comprising a dielectric substrate, said radiating element and said first and second feeding elements being formed on said dielectric substrate.

7. The antenna device as claimed in claim 1, further comprising:

a first parasitic element connected to said grounding element, and including a first segment substantially parallel to said first segment of said radiating element, a second segment substantially parallel to said second segment of said radiating element and said first segment of said first feeding element, and a third segment substantially parallel to said second segment of said first feeding element; and a second parasitic element connected to said grounding element, and including a first segment substantially parallel to said first segment of said radiating element, and a second segment substantially parallel to said third segment of said radiating element and said first segment of said second feeding element.

8. The antenna device as claimed in claim 7, wherein at least one of said first and second parasitic elements is generally L-shaped.

9. The antenna device as claimed in claim 7, wherein said first segment of said radiating element is disposed between said first and second parasitic elements.

10. The antenna device as claimed in claim 7, further comprising a dielectric substrate, said radiating element, said first and second feeding elements, and said first and second parasitic elements being formed on said dielectric substrate.

11. The antenna device as claimed in claim 1, further comprising a feeding line connected to said second segment of said first feeding element.

12. The antenna device as claimed in claim 11, wherein said second segment of said first feeding element has an end distal from said first segment of said first feeding element, said feeding line being connected to said end of said second segment of said first feeding element.

13. The antenna device as claimed in claim 1, further comprising a feeding line connected to said second segment of said second feeding element.

14. The antenna device as claimed in claim 13, wherein said second segment of said second feeding element has an end distal from said first segment of said second feeding element, said feeding line being connected to said end of said second segment of said second feeding element.

* * * * *